US007596497B2

(12) United States Patent
Yamazaki

(10) Patent No.: US 7,596,497 B2
(45) Date of Patent: Sep. 29, 2009

(54) SPEECH SYNTHESIS APPARATUS AND SPEECH SYNTHESIS METHOD

(75) Inventor: Nobuhide Yamazaki, Kanagawa (JP)

(73) Assignee: Sony Corporation (JP)

( * ) Notice: Subject to any disclaimer, the term of this patent is extended or adjusted under 35 U.S.C. 154(b) by 672 days.

(21) Appl. No.: 10/862,656

(22) Filed: Jun. 7, 2004

(65) Prior Publication Data

US 2005/0010414 A1 Jan. 13, 2005

(30) Foreign Application Priority Data

Jun. 13, 2003 (JP) ..... P2003-169988

(51) Int. Cl.
*G10L 13/00* (2006.01)
*G10L 13/06* (2006.01)

(52) U.S. Cl. ..... 704/267; 704/265; 704/258

(58) Field of Classification Search ..... 704/258, 704/265, 268
See application file for complete search history.

(56) References Cited

U.S. PATENT DOCUMENTS

2002/0138253 A1* 9/2002 Kagoshima et al. ..... 704/207

FOREIGN PATENT DOCUMENTS

JP 02-254497 A 10/1990
JP 11-184497 A 7/1999
JP 2002-358090 A 12/2002

* cited by examiner

*Primary Examiner*—David R Hudspeth
*Assistant Examiner*—Samuel G Neway
(74) *Attorney, Agent, or Firm*—Lerner, David, Littenberg, Krumholz & Mentlik, LLP

(57) ABSTRACT

A speech synthesis apparatus and a speech synthesis method, in which a waveform of a desired formant shape may be generated with a small volume of computing operations. A voiced sound generating unit of the speech synthesis apparatus includes n single formant generating units, an adder for summing these outputs to generate a one-pitch waveform, a one-pitch buffer unit, and a waveform overlapping unit for overlapping a number of the one-pitch waveforms as the one-pitch waveform is shifted by one pitch period each time. Each single formant generating unit is supplied with three parameters, namely a center frequency of a formant representing the formant position, a formant bandwidth, and a formant gain and reads out the band characteristics waveform at a readout interval, derived from the bandwidth wn, from a band characteristics waveform storage unit to effect expansion along the time axis. The resulting waveform is multiplied with a sine wave of the center frequency to output a pitch waveform for a formant representing characteristics of a formant.

12 Claims, 9 Drawing Sheets

SPEECH SYNTHESIS APPARATUS AND SPEECH SYNTHESIS METHOD

BACKGROUND OF THE INVENTION

1. Field of the Invention

This invention relates to a method and an apparatus for speech synthesis in which the speech is synthesized from a string of letters or characters or from a string of phoneme symbols. More particularly, it relates to a method and an apparatus for speech synthesis in which the speech is synthesized by overlapping plural pitch waveforms.

This application claims priority of Japanese Patent Application No. 2003-169988, filed in Japan on Jun. 13, 2003, the entirety of which is incorporated by reference herein.

2. Description of Related Art

In a parameter type speech synthesis apparatus, it has so far been known that the quality of the synthesized speech is affected significantly depending on how approximate in expression the spectral envelope characteristics of the speech synthesized may be to those of the natural speech. Up to now, several parameter type speech synthesis systems have been proposed. For example, in the following Non-Patent Cited Document 1, such a formant synthesis system has been proposed in which the formant of the speech is represented by all-pole filters of the order of the degree two, these filters being interconnected in series or in parallel to represent the envelope characteristics of the entire spectrum.

There is also known a parameter synthesis system employing linear predictive coding (LPC) employing in turn the parameters derived from a linear prediction model, or a variety of linear prediction filters, such as LSP (linear spectrum pair) or PARCOR (partial auto-correlation coefficient). The system employing the LSP parameters is described in, for example, the Non-Patent Cited Document 2.

Non-Patent Cited Document 1

Klatt, D. H., "Software for a Cascade/Parallel Formant Synthesis", Journal of the Acoustical Society of America, March 1980, Vol. 67, No. 3, pp. 971 to 995.

Non-Patent Cited Document 2

Sadaoki Furui, "Digital Speech Processing", Tokai University Publishing Section, pp. 89 to 98.

However, the formant synthesis and the synthesis system for the linear prediction system is basically the all-pole model and, when seen on a Z-plane, a formant is merely expressed by a sole zero point. FIGS. 9A and 9B are graphs showing the characteristics of an all-pole filter of the degree two by taking the amplitude and the frequency on the ordinate and on the abscissa, respectively. The frequency characteristics of the all-pole filter, represented by $Y_i=aX_i+bY_{i-1}+cY_{i-2}$, where X and Y are input and output signals, respectively, are featured by the fact that the bandwidth w or the center frequency fc of the formant, shown in FIG. 9A, cannot be controlled independently. That is, if the bandwidth w or the center frequency fc is changed individually, the shape of the spectral characteristics itself is changed significantly. For example, if the bandwidth is narrowed, as shown in FIG. 9B, the shape of the graph in the vicinity of peak area becomes sharp. Thus, the resulting sound is such a one in which emphasis is placed on only a limited portion of the formant frequency. That is, the method employing the all-pole filter suffers from the problem that parameter adjustment is highly critical such that it is difficult to obtain the desired frequency characteristics.

Moreover, since the side lobe is moderate, change of a parameter representing a formant affects the shape of the frequency ranges of other formants present ahead and at back of the formant, such that individual formants cannot be controlled by individual parameters.

SUMMARY OF THE INVENTION

In view of the above-described status of the art, it is an object of the present invention to provide a speech synthesis method and a speech synthesis apparatus whereby the waveform of a desired formant shape may be generated with a small volume of processing operations.

In one aspect, the present invention provides a speech synthesis apparatus comprising waveform generating means for generating a plurality of pitch waveforms, each for a formant, as pitch waveforms, each for one pitch, associated with each formant, one-pitch waveform generating means for adding the pitch waveforms for the formants to generate a one-pitch waveform, and overlapping means for overlapping a plurality of the one-pitch waveforms to synthesize a speech. The waveform generating means includes band characteristics waveform storage means, having stored therein a plurality of band characteristics waveform of a time domain, each having a band limited so as to be lesser than a preset frequency, band characteristics waveform readout means for reading out the band characteristics waveforms, stored in the band characteristics waveform storage means, at a desired readout interval, to output a plurality of band characteristics readout waveforms expanded or contracted along time axis, sine wave outputting means for outputting a sine wave, and multiplication means for multiplying the band characteristics readout waveforms with the sine wave to output the resulting waveform.

According to the present invention, the band characteristics waveform is readout at a desired readout interval, such as a readout interval derived from, for example, the bandwidth of the band characteristics waveform and the bandwidth of the corresponding formant, to generate the band characteristics readout waveform expanded along time axis to give a one-pitch waveform extremely readily. This band characteristics readout waveform is multiplied with a sine wave, whereby a one-pitch waveform is generated by multiplication of the pitch waveform for the formant, generated in association with each formant. A series of such one-pitch waveforms are overlapped to synthesize the speech.

The sine wave outputting means includes sine wave storage means, having a sine wave stored therein, and sine wave readout means for reading out the sine wave stored in the sine wave storage means as a sine wave of a desired frequency.

The one-pitch waveform generating means may add the pitch waveforms for the formants so that the center positions of the pitch waveforms for the formants are aligned with one another.

There may also be provided gain adjustment means for adjusting the gain of the waveforms from the multiplication means based on a ratio of the bandwidth of the band characteristics waveform to the bandwidth of the corresponding formant, whereby it is possible to adjust the gain changed with the readout interval of the band characteristics waveform.

The multiplication means may multiply the band characteristics readout waveform with the sine wave, in a synchronized relationship, such as by overlapping the peak of the band characteristics readout waveform with the peak of the sine wave, or by overlapping the center point of the band characteristics readout waveform with the zero-crossing point of the sine wave, in carrying out the multiplication, in case the band characteristics readout waveform is an odd function, whereby the gain may be prevented from being lowered in case the band characteristics readout waveform is multiplied with the sine wave of a lower frequency.

In another aspect, the present invention provides a speech synthesis method comprising a waveform generating step of generating a plurality of pitch waveforms, each for a formant, as pitch waveforms, each for one pitch, associated with each formant, a one-pitch waveform generating step of adding the pitch waveforms for the formants to generate a one-pitch waveform, and a overlapping step of overlapping a plurality of the one-pitch waveforms to synthesize a speech. The waveform generating step includes a band characteristics waveform storage step, having stored therein a plurality of band characteristics waveform of a time domain, each having a band limited so as to be lesser than a preset frequency, a band characteristics waveform readout step of reading out the band characteristics waveforms, stored in the band characteristics waveform storage step, at a desired readout interval, to output a plurality of band characteristics readout waveforms expanded or contracted along time axis, a sine wave outputting step of outputting a sine wave, and a multiplication step of multiplying the band characteristics readout waveforms with the sine wave to output the resulting waveform.

The speech synthesis apparatus of the present invention comprises waveform generating means for generating a plurality of pitch waveforms, each for a formant, as pitch waveforms, each for one pitch, associated with each formant, one-pitch waveform generating means for adding the pitch waveforms for the formants to generate a one-pitch waveform, and overlapping means for overlapping a plurality of the one-pitch waveforms to synthesize a speech. The waveform generating means includes band characteristics waveform storage means, having stored therein a plurality of band characteristics waveform of a time domain, each having a band limited so as to be lesser than a preset frequency, band characteristics waveform readout means for reading out the band characteristics waveforms, stored in the band characteristics waveform storage means, at a desired readout interval, to output a plurality of band characteristics readout waveforms expanded or contracted along time axis, sine wave outputting means for outputting a sine wave; and multiplication means for multiplying the band characteristics readout waveforms with the sine wave to output the resulting waveform. Thus, by using different readout time periods of the band characteristics readout waveform, the band characteristics readout waveform, time-expanded to give a one-pitch waveform, may readily be generated with a small amount of computations. Hence, the one-pitch waveform, having the desired formant shape, may be generated to synthesize the speech with a smaller volume of processing operations.

DESCRIPTION OF THE PREFERRED EMBODIMENTS

Figure 1:
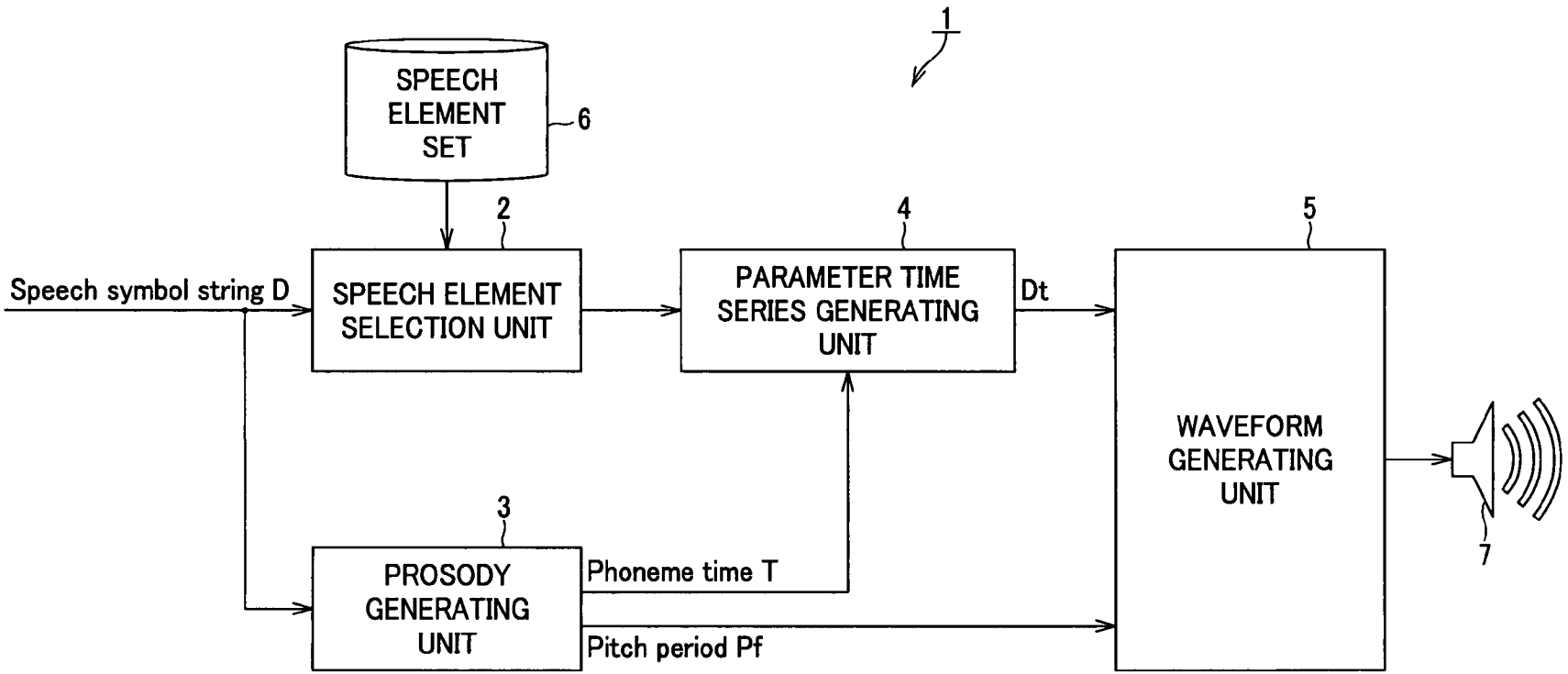
FIG. 1 is a block diagram showing an overall structure of a rule based speech synthesis apparatus embodying the present invention.

Referring to the drawings, preferred embodiments of the present invention are now explained in detail. In these embodiments, the present invention is applied to a rule based speech generating apparatus in which one-pitch waveforms are generated from formant parameters (bandwidths, center frequencies and gains of respective formants) and overlapped together to synthesize the speech.

FIG. 1 depicts a block diagram showing an overall structure of a rule based speech generating apparatus 1 embodying the present invention. Referring to FIG. 1, the rule based speech generating apparatus 1 includes a speech element selection unit 2 and a prosody generating unit 3, supplied with a speech symbol string D, containing phoneme strings and the prosody information, and a parameter time series generating unit 4 for generating time series of parameters responsive to the speech element parameters selected and output by the speech element selection unit 2 and to the phoneme time duration from the prosody generating unit 3. The rule based speech generating apparatus 1 also includes a waveform generating unit 5 for generating the waveform of the synthesized speech by the time series of parameters and a pitch period Pf from the prosody generating unit 3.

The speech element selection unit 2 is connected to a memory 6 where a plural number of speech element sets are stored. Each speech element set is data corresponding to a sequence of phonemes and acoustic characteristics parameters paired together. The sequence of phonemes, such as CVC, VCV, CV or VC, where C denotes a consonant and V denotes a vowel, is obtained by selecting, from a speech database holding a relatively large quantity of synthesis units, a relatively small number of speech element sets such as to statistically reduce the concatenation distortion. The speech element selection unit 2 sequentially selects and outputs parameters of appropriate speech element sets stored in the memory 6, based on a speech symbol string D containing the phoneme string and the prosody information.

The phoneme string, entered to the speech element selection unit 2, is data for representing a phoneme string for utterance, obtained by morpheme analysis for text speech synthesis and by phonetic symbol string generating processing. The speech element selection unit 2 refers to the speech element set, based on the input phoneme strings, to select the phoneme string contained in the phoneme strings, to readout acoustic characteristic parameters corresponding to the selected phoneme strings, such as cepstrum coefficients, from the speech element.

The prosody generating unit 3 generates the time duration T and the pitch Pf of each phoneme, from the speech symbol string D, to output the so generated time duration and pitch to the parameter time series generating unit 4 and to the waveform generating unit 5.

The parameter time series generating unit 4 receives a phoneme time duration T from the prosody generating unit 3 and generates the speech symbol string Dt to output the so generated string Dt, as the parameter time series generating unit expands or contracts the parameter received from the speech element selection unit 2 depending on the phoneme time duration T.

The waveform generating unit 5 generates the synthesized speech, based on a time series of parameters Dt, changed from moment to moment, output from the parameter time series generating unit 4, and the pitch period Pf, equally changed from moment to moment, supplied from the prosody generating unit 3, to output the so generated synthesized speech to a loudspeaker 7. This waveform generating unit 5 is provided with plural generating units for generating plural sorts of speech waveforms, such as a frictional signal generating unit, a plosive generating unit or a voiced sound generating unit, in order to generate a large variety of speech waveforms. The waveform generating unit synthesizes these various signals to generate a synthesized waveform.

The above-described block structure of the speech synthesis apparatus is of general character and may be replaced by other pre-existing structures of the speech synthesis apparatus. The structure and the operation of the blocks except the waveform generating unit may also be those of the speech synthesis apparatus of general character.

Figure 2:
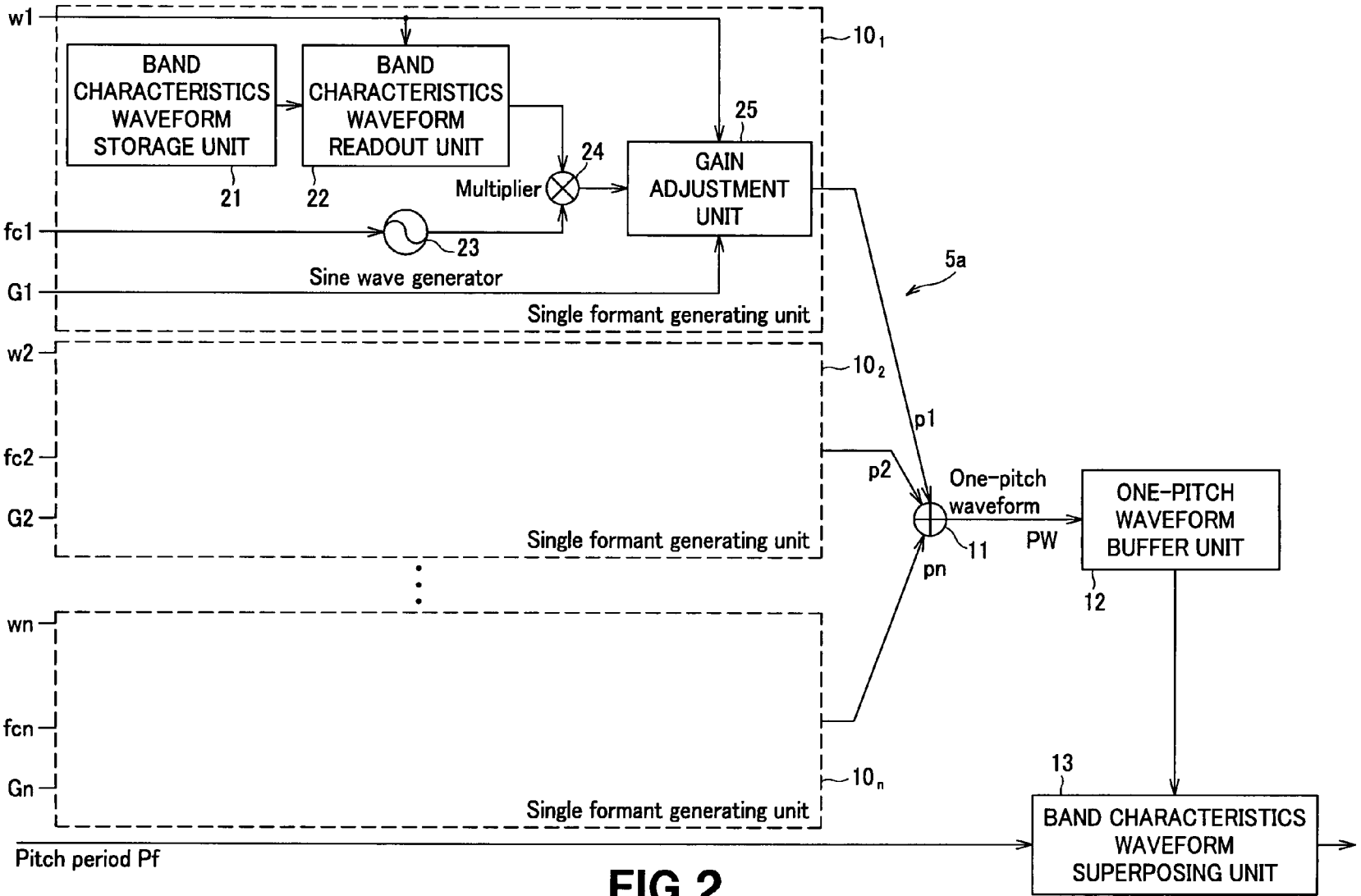
FIG. 2 is a block diagram showing the voiced sound generating unit for generating the waveform of the voiced sound of the rule based speech synthesis apparatus embodying the present invention.

In connection with a variety of speech sorts, used in generating the synthetic waveforms, the inner structure of the waveform generating unit, as a feature of the present invention, is explained. FIG. 2 is a block diagram showing an apparatus for generating the waveform of the voiced sound. Referring to FIG. 2, a voiced sound generating unit 5*a*, conveniently used for the waveform generating unit shown in FIG. 1, is made up by n single formant generating units 10*n*, an adder 11 for summing the outputs of the formant generating units to generate a one-pitch waveform, a one-pitch waveform buffer unit 12 for buffering this one-pitch waveform, and a waveform overlapping unit 13 for overlapping a plural number of the one-pitch waveforms based on the pitch period Pf supplied from the prosody generating unit 3 shown in FIG. 1.

Figure 3A:
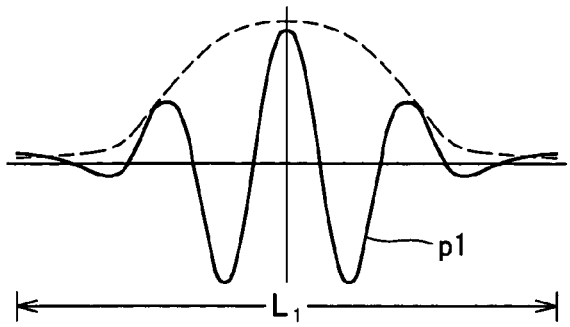
FIGS. 3A to 3C are graphs showing waveforms generated by formant generating units.
Figure 3B:
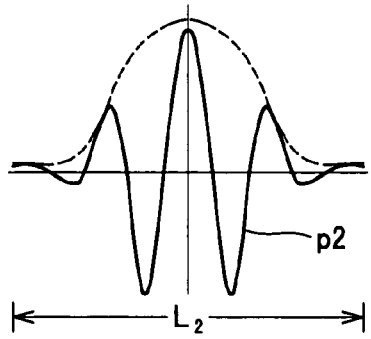
Figure 3C:
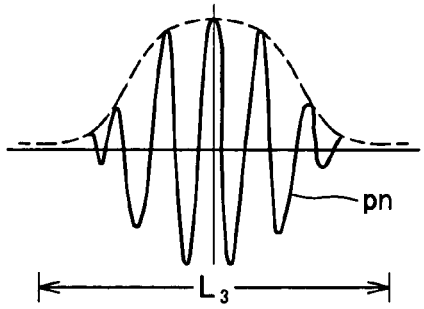

Each single formant generating unit 10*n*, generating a waveform corresponding to a single formant, is supplied with three parameters, namely a center frequency fcn of a formant specifying the formant position, a bandwidth wn of a formant, and formant size (gain) Gn, as inputs, to output a one-pitch waveform representing characteristics of a formant (pitch waveform for a formant). For example, by the formant generating units $\mathbf{10}_1$, $\mathbf{10}_2$ and $\mathbf{10}_n$, pitch waveforms for formants $p_1$, $p_2$ and $p_n$, representing one-pitch waveforms, as shown in FIGS. 3A to 3C, are output, respectively.

Figure 3D:
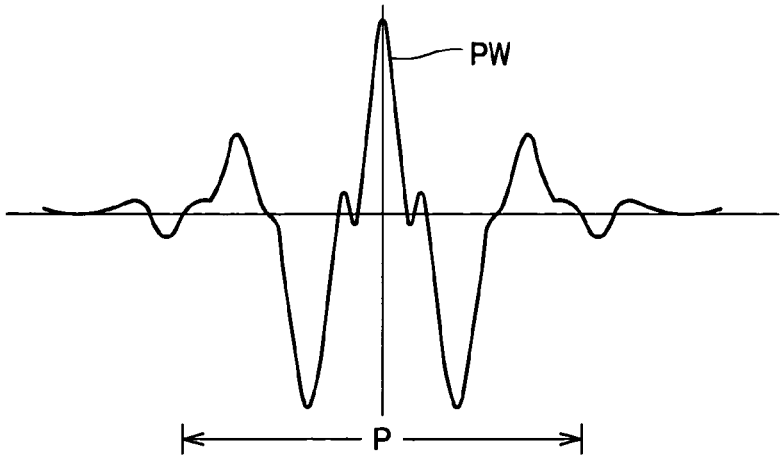
FIG. 3D is a graph showing a waveform of a one-pitch waveform generated on summation by an adder as a pitch waveform generating unit.

The adder 11 overlaps the pitch waveforms for formants, output from the respective single formant generating units 10*n*, together, to generate a synthesized one-pitch waveform PW, shown for example in FIG. 3D, representing plural formant characteristics, to cause the so generated one-pitch waveform PW to be stored in the one-pitch waveform buffer unit 12. Meanwhile, it is unnecessary for the lengths $L_1$ to $L_n$ of the pitch waveforms for the formants, shown in FIGS. 3A to 3C, to be equal to the length of the synthesized one-pitch waveform, while it is unnecessary for the lengths $L_1$ to $L_n$ of the formant pitch waveforms to be equal to one another. However, when the pitch waveforms for the formants are summed together to generate the one-pitch waveform, the respective pitch waveforms for the formants need to be summed so that the center positions of the pitch waveforms for the formants are coincident with one another. It is noted that the length of the generated synthesized one-pitch waveform PW is longer than the actual pitch (pitch period length) P.

The waveform overlapping unit 13 overlaps a plural number of one-pitch waveforms PW, generated as described above, as the waveforms are shifted with the specified pitch period Pf, to output the synthesized speech having frequency characteristics specified by the respective parameters of the respective formants and the pitch of the speech specified by the pitch period Pf.

The single formant generating unit 10*n* is made up by a band characteristics waveform storage unit 21, having stored therein a band characteristics waveform, provided with band characteristics of the corresponding formant, a band characteristics waveform readout unit 22 for reading out the band characteristics waveform from the band characteristics waveform storage unit 21 at a readout interval corresponding to a bandwidth wn of the corresponding formant, a sine wave generating unit 23 for generating and outputting the sine wave of the center frequency fcn of the corresponding formant, specified from outside, a multiplier 24 for multiplying the band characteristics waveform readout from the band characteristics waveform readout unit 22 with the sine wave with the frequency fcn, and a gain adjustment unit 25 for adjusting the gain of the generated waveform.

The band characteristics waveform storage unit 21 has stored therein the time-domain waveform, provided with band characteristics of the formant, as frequency characteristics of a desired pass band, and having the frequency limited to a low range, as waveform data formulated in accordance with e.g. a method which will be explained subsequently. The data size (number of samples) of the table needs to be large enough to permit sufficient attenuation of the signal level at the leading and trailing waveform ends.

It is sufficient that the length Lo of the band characteristics waveform is on the order of 4096 samples, depending on the shape of the band characteristics waveform, in case the sampling frequency is 22 kHz and the fundamental bandwidth wo, as the bandwidth of the band characteristics waveform, as later explained, equal to 12 Hz. In each single formant generating units 10*n*, shown in FIGS. 3A to 3C, the length Ln of a band characteristics readout waveform, which is the band characteristics waveform readout with expansion along time axis, is Lo×wn/wo.

The band characteristics waveform readout unit 22 sequentially reads out the values of the band characteristics waveform, stored in the band characteristics waveform storage unit 21, at an interval corresponding to the bandwidth wn, supplied from outside, as being the bandwidth of the corresponding formant. The band characteristics readout waveform, corresponding to the band characteristics waveform as readout at a readout interval in keeping with the bandwidth wn, is output. The sine wave generating unit 23 outputs a sine wave of a frequency fcn specified from outside as being the center frequency fcn of the corresponding formant. The multiplier 24 multiplies an output of the band characteristics waveform readout unit 22 with an output of the sine wave generating unit 23 and outputs the resulting product. The gain adjustment unit 25 adjusts the sound volume of an input signal, for each formant, by the signal strength (gain) Gn, as specified from outside as a value corresponding to the corresponding formant, and by the bandwidth wn, to output the resulting signal.

The operation of the voiced sound generating unit 5*a*, shown in FIG. 2, is now explained. In the band characteristics waveform readout unit 22, there are stored a readout location (memory address) and a readout interval. With the bandwidth wo in Hz, when the band characteristics waveform has been formed, and with the bandwidth specified from outside wn in Hz, the read out interval may be set to wn/wo. Since this value is usually a decimal, it is sufficient if the readout interval and the readout location are each stored as a decimal and the number readout from the band characteristics waveform storage unit 21 is the number from which the subdecimal digits are truncated. For example, if the fundamental bandwidth wo is 15 Hz and the bandwidth wn specified from outside is 200 Hz, the readout interval is 13.33, such that readout is made from every 13th position.

In this manner, the band characteristics readout waveform, in which the length Lo of the band characteristics waveform has been time-expanded in keeping with the time of one pitch, is output. It is noted that the length Ln of the band characteristics readout waveform does not have to be equal to the time of one-pitch waveform.

The sine wave generating unit 23 sequentially outputs a sine wave of the frequency equal to the center frequency fcn of the corresponding formant. In case the center frequency fcn is variable, it is sufficient if the sine wave of the frequency equal to the frequency fcn specified from outside is generated and output.

Outputs of the band characteristics waveform readout unit 22 and the sine wave generating unit 23 are multiplied with each other by the multiplier 24 and supplied to the gain adjustment unit 25.

The gain adjustment unit 25 multiplies an input signal, as an output of the multiplier 24, with Gn×wn/wo, and outputs the resulting product, where Gn is the intensity of a signal supplied from outside, and wn/wo is a correction value for the gain in case the bandwidth is variable.

An output of the single formant generating unit 10*n* holds the shape of the band characteristics waveform and hence has frequency characteristics of a pass band which will give the shape of the formant. Thus, the output of the single formant generating unit is the pitch waveform for the formant which is the waveform of one pitch which is in keeping with the center frequency fcn, bandwidth wn and the gain Gn of the corresponding formant.

The one-pitch waveforms, thus generated, are summed by the adder 11, as the pitch waveform generating unit, so that the one-pitch waveform, provided with the characteristics for the respective formants, is generated, and buffered in the one-pitch waveform buffer unit 12. The so generated one-pitch waveform is supplied to the waveform overlapping unit 13, where plural one-pitch waveforms are overlapped by a waveform overlapping method and output, as the respective waveforms are shifted by an interval of the pitch period Pf supplied.

Figure 4:
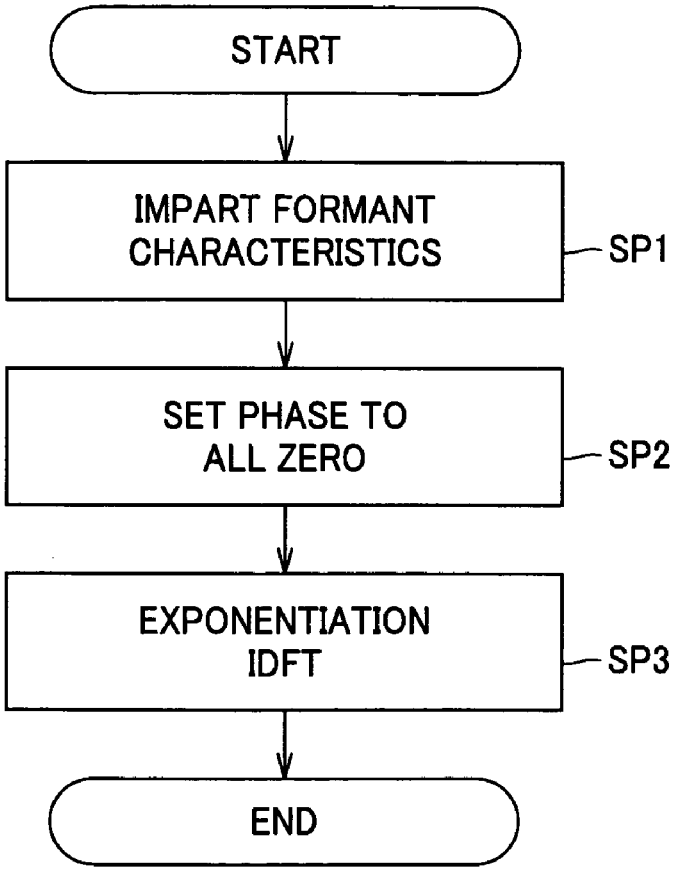
FIG. 4 is a flowchart showing a band characteristics waveform used in the voiced sound generating unit shown in FIG. 2.
Figure 5A:
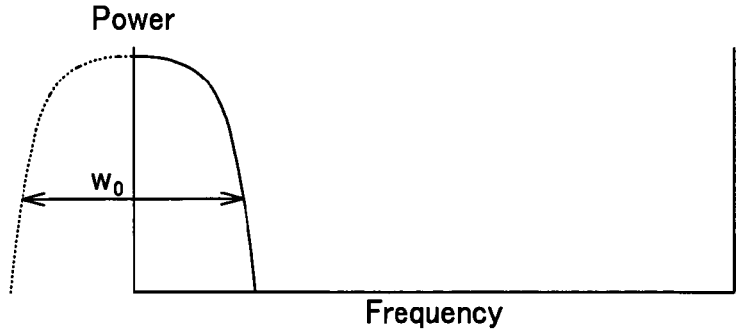
FIGS. 5A to 5C are graphs showing signals generated in the course of a band characteristics waveform generating process.
Figure 5B:
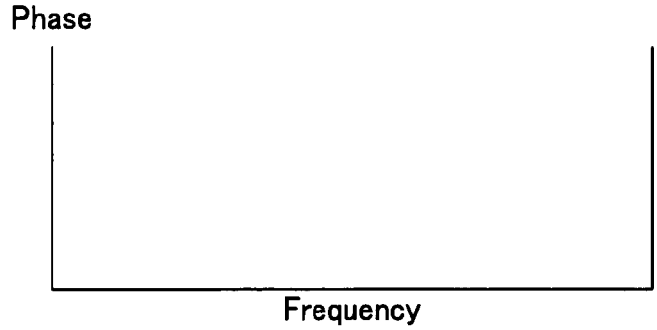
Figure 5C:
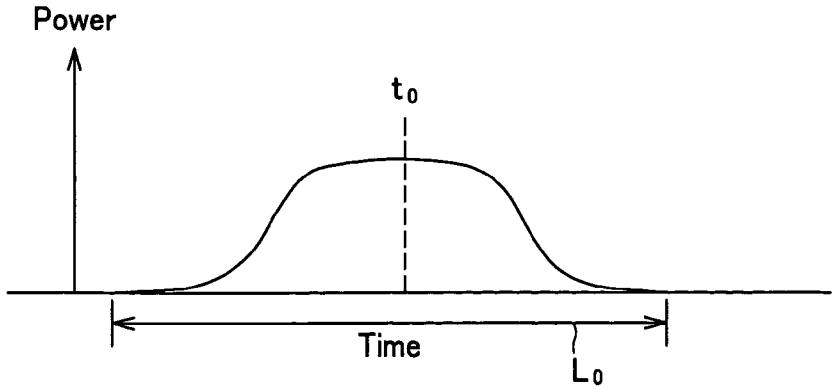

The method for generating the band characteristics waveform, to be stored in the band characteristics waveform storage unit 21, is now explained. FIG. 4 is a flowchart showing the method for generating the band characteristics waveform. FIGS. 5A to 5C are graphs showing signals in the respective steps.

First, a signal provided with frequency characteristics of the formant shape in a log spectral region is formed (step SP1). However, high frequency components need to be removed in order to give frequency characteristics having the center frequency of zero Hz, as shown in FIG. 5A. Hence, the characteristics are those of a low-pass filter. The bandwidth at this time is the fundamental bandwidth $w_o$ of the band characteristics waveform.

The signal phase is then put into order. To this end, it is sufficient if the phase terms are all set to zero to give a zero phase (step SP2).

Then, by exponentiation and inverse DFT (discrete Fourier transform) or FFT (fast Fourier transform), the signal in the frequency domain are transformed into that in the time domain (step SP3). The so obtained waveform is stored as the band characteristics waveform in the band characteristics waveform storage unit 21.

A modification of the single formant generating unit is now explained. The single formant generating units 10*n*, shown in FIG. 2, may be formed similarly to a formant generating units 10*n*, shown in FIG. 6. The sine wave generating unit 23 in the single formant generating units 10*n* may be replaced by a sine wave storage unit 31 and a sine wave readout unit 32. In this case, the center frequency fcn of the formant is supplied to the sine wave readout unit 32. A sine wave, generated in the sine wave storage unit 31, is stored in a table and the value of the sine wave is readout by the sine wave readout unit 32 at an interval corresponding to the frequency fcn specified from outside.

Figure 6:
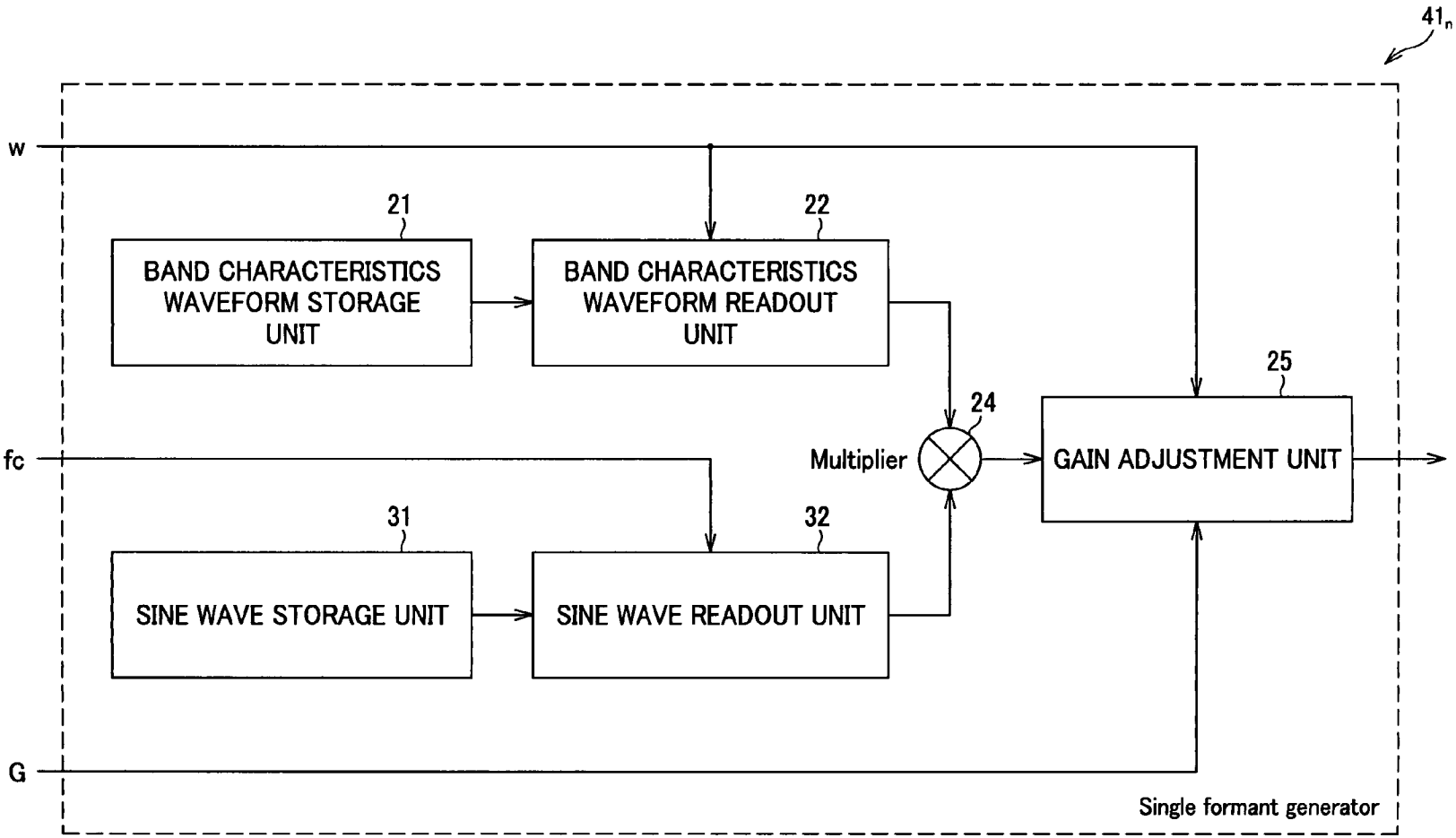
FIG. 6 is a block diagram showing a modification of a single formant generating unit embodying the present invention.

It is sufficient if one each of the band characteristics waveform storage unit 21, shown in FIGS. 2 and 6, and the sine wave storage unit 31, shown in FIG. 6, are provided in the voiced sound generating unit 5*a* of the waveform generating unit 5 so as to be used in common by the respective single formant generating units 10*n* and by the respective single formant generating units 40*n*.

Figure 7A:
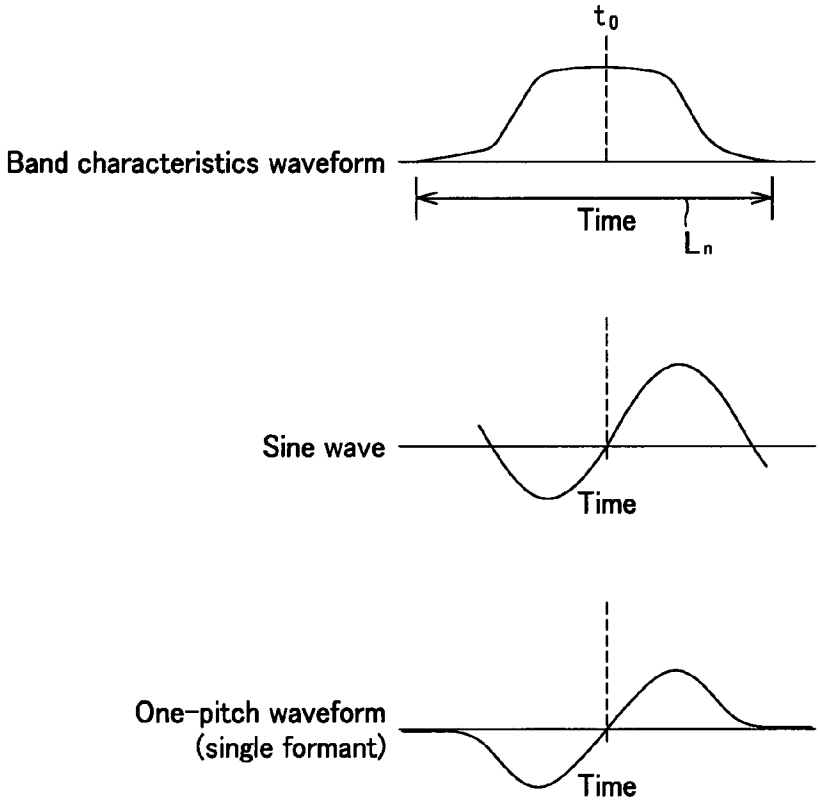
FIGS. 7A and 7B are graphs illustrating the synchronization in multiplying the band characteristics waveform with the sine wave.
Figure 7B:
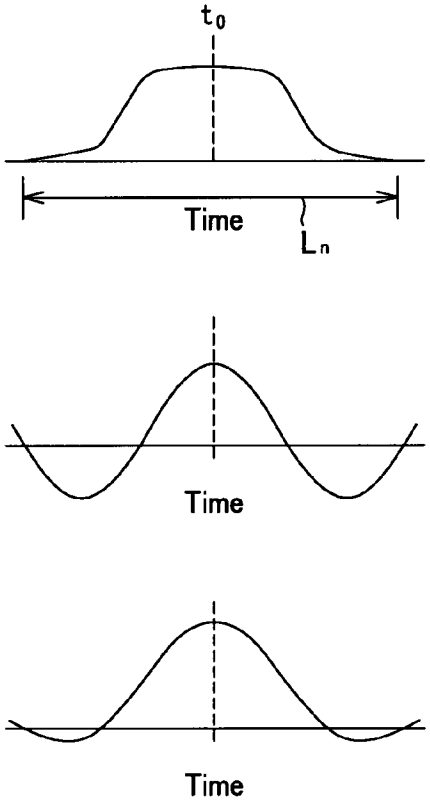

There are occasions where synchronization needs to be taken in multiplying the band characteristics waveform, readout with a readout interval of wn/wo, with the sine wave. FIGS. 7A, 7B illustrate the method for multiplying the band characteristics readout waveform with the sine wave.

If a band characteristics waveform is prepared with the phase zero, the waveform is symmetrical with the center position to as center. If such band characteristics waveform is readout by a band characteristics waveform readout unit, a band characteristics readout waveform, expanded or contracted along time axis in dependence upon the specified bandwidth wn, is output. The length of the band characteristics readout waveform is Ln, as described above. If, when such band characteristics readout waveform is multiplied with the sine wave with the frequency fcn, the center frequency fcn, given as the frequency of the sine wave, is low, and the period thereof approaches the length Ln of the band characteristics readout waveform, the energy of the one-pitch waveform, output following the multiplication, is significantly varied with the phase of the sine wave.

If the peak position of the band characteristics waveform coincides with the zero-crossing position of the sine wave, as shown for example in FIG. 7A, the energy of the one-pitch waveform following the multiplication is lowered. In order to prevent this from occurring, multiplication is carried out at all times with the peak position of the sine wave ($\pi/2$ phase position) coincident with the peak position of the band characteristics waveform. If the center frequency fcn is high such that the sine wave is of a short period, there is scarcely any adverse effect, and hence there is no necessity for taking the synchronization.

Figure 8A:
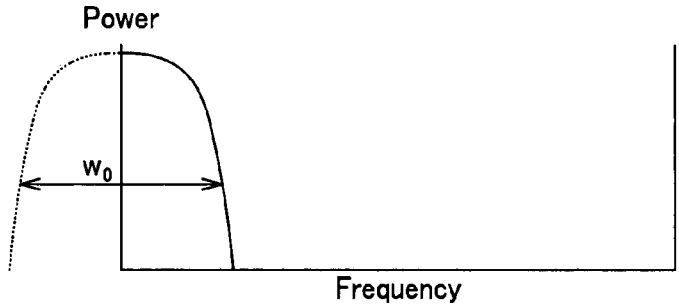
FIGS. 8A to 8C are graphs showing signals generated in the course of another band characteristics waveform generating process.
Figure 8B:
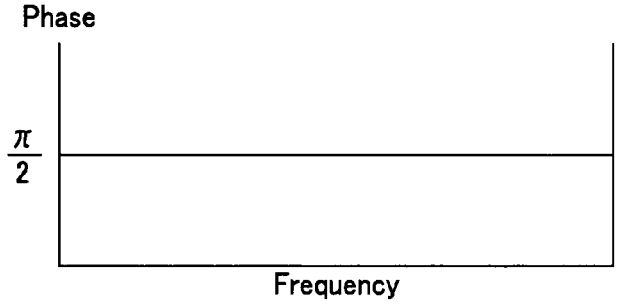
Figure 8C:
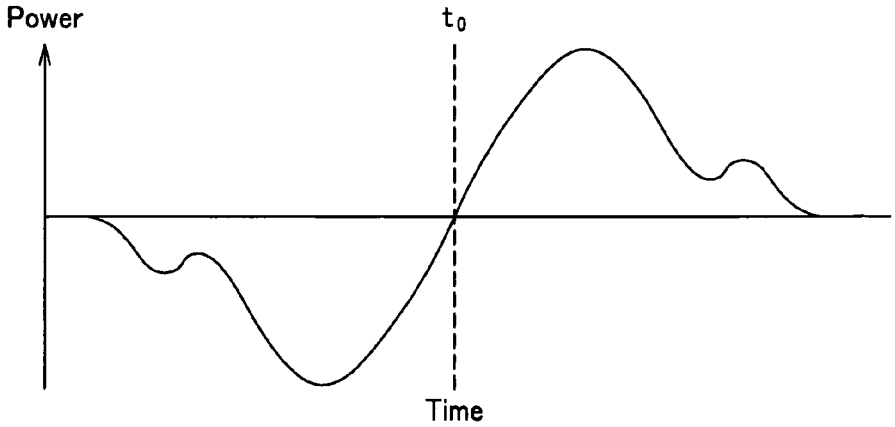
Figure 9B:
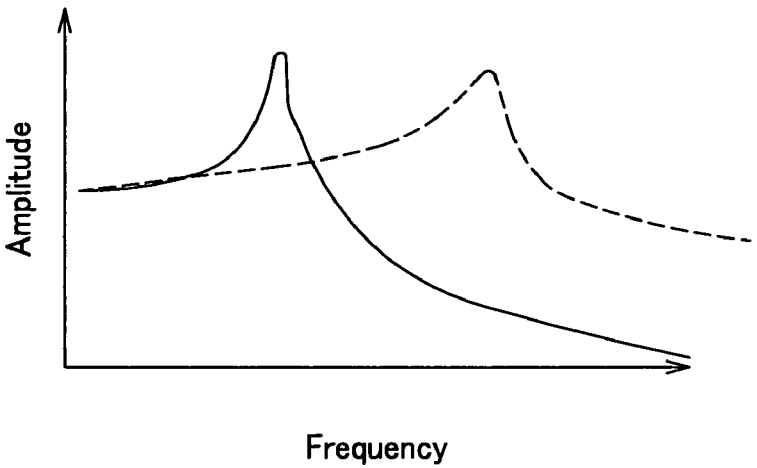
FIGS. 9A and 9B are graphs showing characteristics of a conventional quadratic all-pole filter with the amplitude and the frequency plotted on the ordinate and on the abscissa, respectively.
Figure 9A:
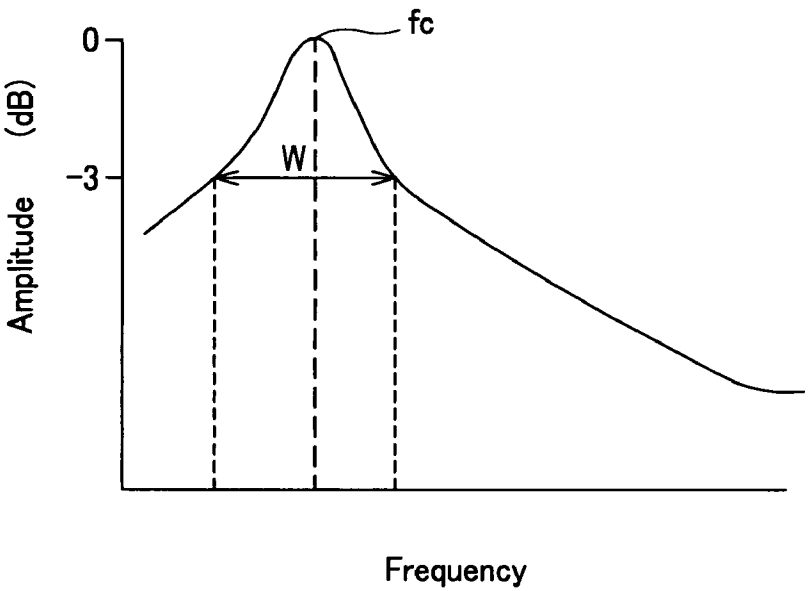

In the above-described embodiment, it is assumed that the band characteristics waveform is generated with all zero phase. It is however possible to generate the band characteristics waveform with the phase all set to e.g. $\pi/2$. FIGS. 8A to 8C are graphs showing another example of generating the band characteristics waveform. After imparting the band characteristics as in FIG. 5A, the phase is set to π/2, as shown in FIG. 8B. If the signal is transformed into a time-domain signal by inverse Fourier transform, the waveform of an odd function, as shown in FIG. 8C, is generated. This waveform may be stored in the band characteristics waveform storage unit 21 as being the band characteristics waveform.

If the band characteristics readout waveform is multiplied with the sine wave in a synchronized relationship, it is sufficient if the multiplication is made so that the center position to of the band characteristics readout waveform, readout with a readout interval of wn/wo, will be coincident with the zero-crossing position of the sine wave.

The speech synthesis apparatus of the above-described embodiment includes formant generating units 10*n*, each generating a one-pitch waveform, associated with a single formant. Each of the formant generating units 10*n* has stored therein a band characteristics waveform, which is a time domain waveform corresponding to the waveform of the relevant formant. Each of the formant generating units 10*n* has pre-stored therein a band characteristics waveform, which is a time-domain waveform of the shape of the relevant formant. Each of the formant generating units 10*n* reads out the band characteristics waveform, stored therein, at a readout interval corresponding to the bandwidth wn of the relevant formant. This band characteristics readout waveform is multiplied with a sine wave of a frequency equivalent to the center frequency fcn of the formant to generate a one-pitch waveform of a single formant, A number of such pitch waveforms for the formants, corresponding to the number of the formants, are overlapped together to generate a one-pitch waveform from the formant parameters (wn, fcn, Gn). In this manner, the band characteristics readout waveform of the desired time duration may readily be generated, as band characteristics are maintained, by varying the readout interval of the band characteristics waveform. Since the one-pitch waveform for a single formant is generated, the one-pitch waveform may be generated, without affecting other formants, even if the frequency fcn or the bandwidth wn, for example, is changed. By so doing, it is possible to control the formants independently of one another, with an extremely small amount of processing operations, to overlap the pitch waveforms of the desired formant characteristics, to synthesize the speech.

The sine wave data, to be multiplied with the band characteristics readout waveform, may be arranged in a table form for storage beforehand, thereby accelerating the processing.

Moreover, the band characteristics readout waveform may be multiplied with the sine wave in a synchronized relationship to prevent the gain from decreasing, in case the formant frequency is lowered, thereby enabling synthesis of the speech having characteristics faithful to parameters.

What is claimed is:

1. A speech synthesis apparatus comprising:

waveform generating means for generating a plurality of pitch waveforms, each for a formant;

one-pitch waveform generating means for adding the plurality of pitch waveforms for the formants to generate a one-pitch waveform; and overlapping means for overlapping a plurality of said one-pitch waveforms to synthesize speech;

said waveform generating means including:

band characteristics waveform storage means having stored therein a plurality of band characteristics waveforms in a time domain, each having a band limited so as to be less than a preset frequency;

band characteristics waveform readout means for reading out said band characteristics waveforms, stored in said band characteristics waveform storage means at a desired readout interval, to output a plurality of band characteristics readout waveforms, expanded or contracted along a time axis;

sine wave outputting means for outputting a sine wave; and multiplication means for multiplying said plurality of band characteristics readout waveforms with said sine wave to output a resulting waveform;

each band characteristics waveform is read out of said storage means at an interval that is based at least on a ratio of a first bandwidth to a second bandwidth, the first bandwidth being a formant bandwidth of the corresponding formant supplied from a source external to the waveform generating means and the second bandwidth being a fundamental bandwidth of the corresponding band characteristic waveform.

2. The speech synthesis apparatus according to claim 1, wherein said sine wave outputting means includes sine wave storage means having a sine wave stored therein and sine wave readout means for reading out said sine wave stored in said sine wave storage means as a sine wave of a desired frequency.

3. The speech synthesis apparatus according to claim 1, wherein said one-pitch waveform generating means sums said plurality of pitch waveforms for the formants are aligned with one another.

4. The speech synthesis apparatus according to claim 1, further comprising:

gain adjustment means for adjusting a gain of the resulting waveforms from said multiplication means based on a ratio of a bandwidth of said band characteristics waveform to a bandwidth of a corresponding formant.

5. The speech synthesis apparatus according to claim 1, wherein said multiplication means multiplies said band characteristics readout waveform with said sine wave in a synchronized relation to each other.

6. The speech synthesis apparatus according to claim 5, wherein multiplication is carried out by said multiplication means as the peak of said band characteristics readout waveform is aligned with the peak of said sine wave.

7. The speech synthesis apparatus according to claim 5, wherein when said band characteristics waveform is an odd function, said multiplication is done as a center point of said band characteristics readout waveform is coincident with a zero-crossing point of said sine wave.

8. A speech synthesis method comprising:

a waveform generating step of using a waveform generating unit to generate a plurality of pitch waveforms, each for a formant;

a one-pitch waveform generating step of adding the pitch waveforms for the formants to generate a one-pitch waveform; and an overlapping step of overlapping a plurality of said one-pitch waveforms to synthesize speech;

said waveform generating step including:

a band characteristics waveform readout step of reading out band characteristics waveforms from a band characteristics waveform storage unit, having stored therein a plurality of band characteristics waveforms of a time domain, each having a band limited so as to be less than a preset frequency, at a desired readout interval, to output a plurality of band characteristics readout waveforms expanded or contracted along a time axis;

a sine wave outputting step of outputting a sine wave; and a multiplication step of multiplying said band characteristics readout waveforms with said sine wave to output a resulting waveform;

each band characteristics waveform is read out of said storage unit at an interval that is based at least on a ratio of a first bandwidth to a second bandwidth, the first bandwidth being a formant bandwidth of the corresponding formant supplied from a source external to the waveform generating unit and the second bandwidth being a fundamental bandwidth of the corresponding band characteristic waveform.

9. The speech synthesis method according to claim 8, wherein said sine wave outputting step includes a sine wave readout step of reading out said sine wave from a sine wave storage unit, having the sine wave stored therein, as a sine wave of a desired frequency.

10. The speech synthesis method according to claim 8, wherein said one-pitch waveform generating step sums said pitch waveforms for the formants so that center positions of said pitch waveforms for the formants are aligned with one another.

11. The speech synthesis method according to claim 8, further comprising:

a gain adjustment step of adjusting a gain of the resulting waveforms from said multiplication step based on a ratio of a bandwidth of said band characteristics waveform to a bandwidth of a corresponding formant.

12. The speech synthesis method according to claim 8, wherein said multiplication step multiplies said band characteristics readout waveform with said sine wave in a synchronized relation to each other.

* * * * *